US007341229B1

(12) United States Patent
Flowers

(10) Patent No.: US 7,341,229 B1
(45) Date of Patent: Mar. 11, 2008

(54) SPINDLE SUPPORTING ASSEMBLY

(76) Inventor: Francis T. Flowers, 110 Windstone Dr., Portsmouth, RI (US) 02871

( * ) Notice: Subject to any disclaimer, the term of this patent is extended or adjusted under 35 U.S.C. 154(b) by 0 days.

(21) Appl. No.: 11/650,508

(22) Filed: Jan. 8, 2007

(51) Int. Cl.
*F16M 11/00* (2006.01)

(52) U.S. Cl. ..... 248/201; 248/301; 242/594.3

(58) Field of Classification Search ..... 242/594.3, 242/597.4, 597.8, 597, 129, 139, 129.6; 248/215, 248/217.1, 217.3, 246, 300, 309.2, 238, 210, 248/211, 201, 227.1, 227.3, 218.4, 219.4, 248/301, 304; 182/129
See application file for complete search history.

(56) References Cited

U.S. PATENT DOCUMENTS 1,597,095 A * 8/1926 Martinsen ..... 248/246
3,156,443 A * 11/1964 Lupinacci ..... 248/211
D237,459 S 11/1975 Wagnor
4,214,718 A 7/1980 Silkey
4,533,091 A * 8/1985 Knight et al. ..... 242/129.6
4,856,729 A * 8/1989 Maraman ..... 242/129
4,995,578 A * 2/1991 Monheim ..... 248/210
5,029,766 A 7/1991 Emming
5,690,301 A 11/1997 Shelton et al.
6,367,754 B1 4/2002 Cinker
6,752,243 B1 * 6/2004 Terzini ..... 182/92

* cited by examiner

*Primary Examiner*—Korie H. Chan

(57) ABSTRACT

A spindle supporting assembly includes a pair of brackets each removably positioned on one of a pair of studs. The studs are spaced from each other. Each of the brackets has one of a pair of arms attached thereto. The arms extend outwardly from one of the studs and are orientated parallel to each other. Each of the arms has an upper edge having a notch therein. The spindle is extended through a reel of wire and positioned in and extended between the notches.

5 Claims, 2 Drawing Sheets

SPINDLE SUPPORTING ASSEMBLY

BACKGROUND OF THE INVENTION

1. Field of the Invention

The present invention relates to spindle supporting devices and more particularly pertains to a new spindle supporting device for supporting a spindle between a pair of studs during the wiring of a dwelling so that a reel of electrical wire or communications conduit can be rotatably mounted on the spindle where needed.

2. Description of the Prior Art

The use of spindle supporting devices is known in the prior art. While these devices fulfill their respective, particular objectives and requirements, the need remains for a device that allows a person to position brackets on studs and utilizes friction, instead of fasteners, to retain the brackets on the studs. This will allow for easy and convenient positioning of the brackets on the studs. Once position, a reel of wire can be rotatably mounted on the brackets.

SUMMARY OF THE INVENTION

The present invention meets the needs presented above by generally comprising a pair of brackets each removably positioned on one of a pair of studs. The studs are spaced from each other and have a pair of lateral surfaces, a front surface and a rear surface. Each of the brackets has a rear wall, a first lateral edge and a second lateral edge. The rear wall is positioned in abutment with an associated one of the rear surfaces. A side wall is attached to the first lateral edge. The side wall extends from the associated one of the rear surfaces to the corresponding one of the front surfaces. The side wall is angled downwardly from the rear wall at an angle between 30 degrees and 60 degrees. A front wall is attached to a distal end of the side wall with respect to the rear wall. The front wall abuts an associated one of the front surfaces. A rear grip is attached to the second lateral edge and extends toward the associated one of the front surfaces. The rear grip extends less than ⅓ of a distance between the associated front and rear surfaces. Each of the brackets has one of a pair of arms attached thereto. The arms extend outwardly from one of the studs and are orientated parallel to each other. Each of the arms has an upper edge having a notch therein. The spindle is extended through a reel of wire and positioned in and extended between the notches.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
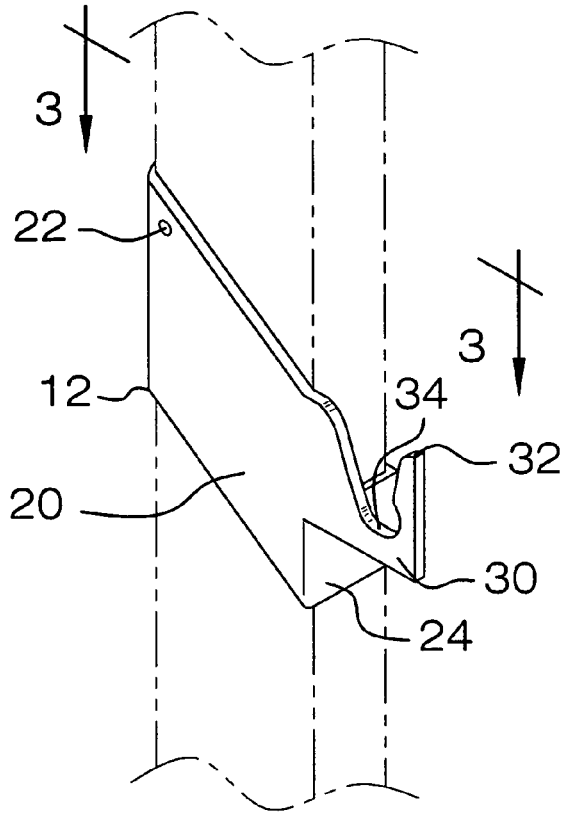
FIG. 1 is a front perspective view of a spindle supporting assembly according to the present invention.
Figure 2:
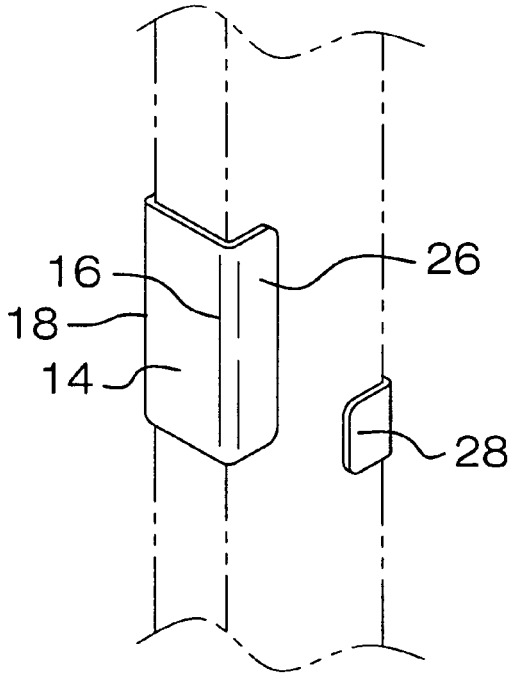
FIG. 2 is a rear perspective view of the present invention.
Figure 3:
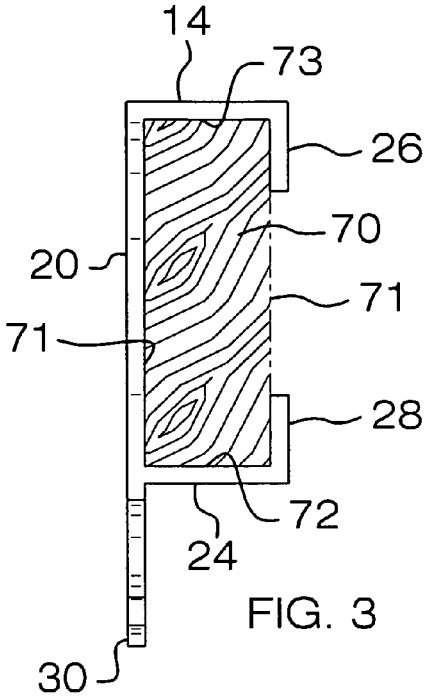
FIG. 3 is a top view taken along line 3-3 of FIG. 1 of the present invention.
Figure 4:
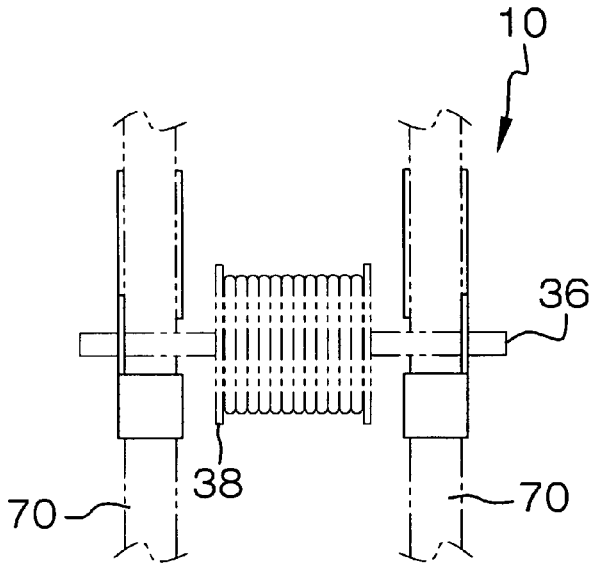
FIG. 4 is a front in-use view of the present invention.
Figure 5:
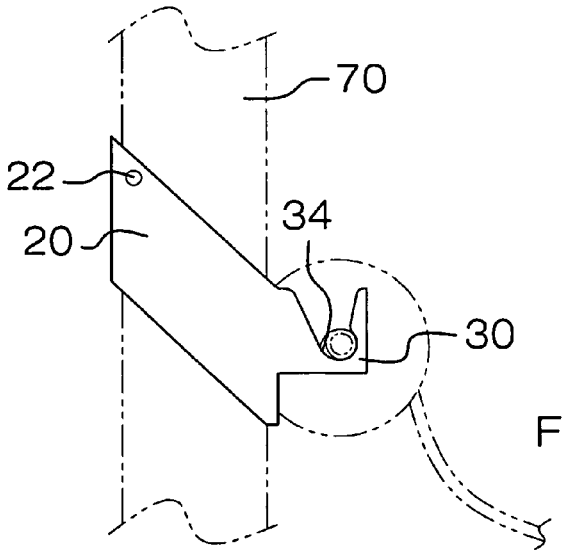
FIG. 5 is a side view of the present invention.

With reference now to the drawings, and in particular to FIGS. 1 through 5 thereof, a new spindle supporting device embodying the principles and concepts of the present invention and generally designated by the reference numeral 10 will be described.

As best illustrated in FIGS. 1 through 5, the spindle supporting assembly 10 generally comprises a pair of brackets 12. Each of the brackets 12 is removably positioned on one of a pair of studs 70. The studs 70 are spaced from each other and each includes a pair of lateral surfaces 71, a front surface 72 and a rear surface 73.

Each of the brackets 12 includes a rear wall 14 that has a first lateral edge 16 and a second lateral edge 18. The rear wall 14 is positioned in abutment with an associated one of the rear surfaces 73. A side wall 20 is attached to the first lateral edge 16. The side wall 20 extends from the associated one of the rear surfaces 73 to the corresponding one of the front surfaces 72. The side wall 20 is angled downwardly from the rear wall 14 at an angle between 30 degrees and 60 degrees. The side wall 20 has an aperture 22 extending therethrough. A fastener, such as a stable or nail, may be extended though the aperture 22 and into an associated one of the studs 70 to prevent the bracket 12 from sliding down the stud 70. A front wall 24 is attached to a distal end of the side wall 20 with respect to the rear wall 14. The front wall 24 abuts an associated one of the front surfaces 72. A rear grip 26 is attached to the second lateral edge 18 and extends toward the associated one of the front surfaces 72. The rear grip 26 extends less than ⅓ of a distance between the associated front 72 and rear 73 surfaces. A front grip 28 is attached to the front wall 24 distal to the side wall 20 and extends toward the associated one of the rear surfaces 73. The front grip 28 extends less than ⅓ of the distance between the associated front 72 and rear 73 surfaces.

A pair of arms 30 is provided. Each of the brackets 12 has one of the arms 30 attached thereto. The arms 30 each extend outwardly from one of the studs 70 and is orientated parallel to each other. Each of the arms 30 has an upper edge 32 having a notch 34 therein. The arms 30 are each positioned at a juncture of one of the front 24 and side 20 walls and are coplanar with an associated one of the side walls 20.

In use, a spindle 36 is extended through a reel 38 of wire and positioned in and extended between the notches 34. This will allow the reel 38 to freely spin on the spindle 36 and allow convenient positioning of the reel 38 where needed during the wiring of a dwelling. The angled nature of the side wall 20 and the limited length of the front 28 and rear 26 grips allows a user of the brackets 12 to remove or position the brackets 12 on the studs 70 without fasteners and to more easily position them at a desired height on the studs 70.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spindle supporting apparatus to support a spindle between a pair of spaced studs, each of the studs having a pair of lateral surfaces, a front surface and a rear surface, said apparatus comprising:

a pair of brackets, each of said brackets being removably positioned on one of the studs, each of said brackets comprising;

a rear wall having a first lateral edge and a second lateral edge, said rear wall being positioned in abutment with an associated one of the rear surfaces;

a side wall being attached to said first lateral edge, said side wall extending from the associated one of the rear surfaces to the corresponding one of the front surfaces;

a front wall being attached to a distal end of said side wall with respect to said rear wall, said front wall abutting an associated one of the front surfaces, said front and back walls being oriented parallel to each other;

a rear grip being attached to said second lateral edge and extending toward the associated one of the front surfaces, said rear grip extending less than ⅓ of a distance between the associated front and rear surfaces;

a pair of arms, each of said brackets having one of said arms attached thereto, said arms each extending outwardly from one of the studs and being orientated parallel to each other, each of said arms having an upper edge having a notch extending downwardly therein, each of said arms being positioned at a juncture of one of said front and side walls and being coplanar with an associated one of said side walls; and wherein the spindle is extended through a reel of wire and positioned in and extended between said notches.

2. The apparatus according to claim 1, wherein each of said brackets further includes said side walls each having an aperture extending therethrough, wherein fasteners may be extended though said apertures and into an associated one of the studs.

3. The apparatus according to claim 1, wherein each of said brackets further includes a front grip being attached to said front wall distal to said side wall and extending toward the associated one of the rear surfaces, said front grip extending less than ⅓ of the distance between the associated front and rear surfaces.

4. The apparatus according to claim 1, wherein said side wall is angled downwardly from said rear wall at an angle between 30 degrees and 60 degrees.

5. A spindle supporting apparatus to support a spindle between a pair of spaced studs, each of the studs having a pair of lateral surfaces, a front surface and a rear surface, said apparatus comprising:

a pair of brackets, each of said brackets being removably positioned on one of the studs, each of said brackets comprising;

a rear wall having a first lateral edge and a second lateral edge, said rear wall being positioned in abutment with an associated one of the rear surfaces;

a side wall being attached to said first lateral edge, said side wall extending from the associated one of the rear surfaces to the corresponding one of the front surfaces, said side wall being angled downwardly from said rear wall at an angle between 30 degrees and 60 degrees, said side wall having an aperture extending therethrough, wherein a fastener may be extended though said aperture and into an associated one of the studs;

a front wall being attached to a distal end of said side wall with respect to said rear wall, said front wall abutting an associated one of the front surfaces, said front and back walls being oriented parallel to each other;

a rear grip being attached to said second lateral edge and extending toward the associated one of the front surfaces, said rear grip extending less than ⅓ of a distance between the associated front and rear surfaces;

a front grip being attached to said front wall distal to said side wall and extending toward the associated one of the rear surfaces, said front grip extending less than ⅓ of the distance between the associated front and rear surfaces, a pair of arms, each of said brackets having one of said arms attached thereto, said arms each extending outwardly from one of the studs and being orientated parallel to each other, each of said arms having an upper edge having a notch extending downwardly therein, each of said arms being positioned at a juncture of one of said front and side walls and being coplanar with an associated one of said side walls; and wherein the spindle is extended through a reel of wire and positioned in and extended between said notches.

* * * * *